US009364893B2

(12) United States Patent
Tomita et al.

(10) Patent No.: US 9,364,893 B2
(45) Date of Patent: Jun. 14, 2016

(54) DIE CASTING APPARATUS

(71) Applicant: TOYOTA JIDOSHA KABUSHIKI KAISHA, Toyota-shi (JP)

(72) Inventors: Takashi Tomita, Toyota (JP); Makoto Kikuchi, Nissin (JP); Takayuki Koganezawa, Okazaki (JP); Yuji Kayashita, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 14/803,691

(22) Filed: Jul. 20, 2015

(65) Prior Publication Data

US 2016/0031003 A1 Feb. 4, 2016

(30) Foreign Application Priority Data

Jul. 31, 2014 (JP) ..... 2014-157099

(51) Int. Cl.
*B22D 17/30* (2006.01)
*B22D 17/04* (2006.01)
*B22D 17/20* (2006.01)

(52) U.S. Cl.
CPC ..... *B22D 17/20* (2013.01); *B22D 17/04* (2013.01); *B22D 17/30* (2013.01)

(58) Field of Classification Search
CPC ..... B22D 17/02; B22D 17/04; B22D 17/20; B22D 17/30
USPC ..... 164/113, 312–318
See application file for complete search history.

(56) References Cited

U.S. PATENT DOCUMENTS 6,478,075 B1 * 11/2002 Shibata ..... B22D 17/007 164/113
6,953,079 B2 * 10/2005 Suzuki ..... B22D 17/2236 164/256
2014/0216678 A1 8/2014 Kikuchi

FOREIGN PATENT DOCUMENTS

JP 2013-066896 4/2013

* cited by examiner

*Primary Examiner* — Kevin E Yoon
(74) *Attorney, Agent, or Firm* — Oblon, McClelland, Maier & Neustadt, L.L.P.

(57) ABSTRACT

A die casting apparatus includes: an electromagnetic pump body disposed at a plunger sleeve-side end portion of a molten metal holding furnace; and a connecting pipe connected to the electromagnetic pump body and the plunger sleeve to provide communication between the electromagnetic pump body and a molten metal feed port, the connecting pipe being separable from the electromagnetic pump body. The die casting apparatus further includes a moving mechanism configured to allow the electromagnetic pump body to move between an inclined state where the electromagnetic pump body is inclined with respect to a horizontal plane in the molten metal holding furnace at an angle of approximately 45 degrees and an upright state where the electromagnetic pump body is perpendicular to the horizontal plane in the molten metal holding furnace.

4 Claims, 8 Drawing Sheets

DIE CASTING APPARATUS

INCORPORATION BY REFERENCE

The disclosure of Japanese Patent Application No. 2014-157099 filed on Jul. 31, 2014 including the specification, drawings and abstract is incorporated herein by reference in its entirety.

BACKGROUND OF THE INVENTION

1. Field of the Invention

The invention relates generally to a die casting apparatus, and more specifically to a die casting technique of performing casting by injecting molten metal into a cavity of a mold.

2. Description of Related Art

In a die casting apparatus according to related art, the following technique is adopted: a pump disposed at a molten metal holding furnace and a molten metal feed port of a plunger sleeve are communicated with each other through a connecting pipe; and molten metal drawn by the pump up from the molten metal holding furnace is injected into the plunger sleeve through the connecting pipe (see, for example, Japanese Patent Application Publication No. 2013-66896 (JP 2013-66896 A)).

In the die casting apparatus described in JP 2013-66896 A, the pump is fixed to the molten metal holding furnace. This configuration makes a work space for replacing, for example, a plunger tip or a support shaft narrow, thus hindering the maintenance efficiency.

SUMMARY OF THE INVENTION

The invention provides a die casting apparatus configured to prevent a pump from becoming an obstacle to a maintenance work performed by a worker, thereby ensuring a sufficiently wide work space around the die casting apparatus.

One aspect of the invention will be described below.

A die casting apparatus according to the one aspect of the invention includes: a mold having a cavity; a plunger sleeve having a molten metal feed port, the plunger sleeve being communicated with the cavity; a plunger tip provided at a distal end portion of a support shaft, the plunger tip configured to be slidable in the plunger sleeve in an axial direction of the plunger sleeve when the support shaft is inserted into the plunger sleeve; a molten metal holding furnace in which molten metal is stored; and a pump that feeds the molten metal from the molten metal holding furnace into the plunger sleeve. Casting is performed through an injecting operation in which the molten metal fed into the plunger sleeve is extruded by the plunger tip to be injected into the cavity. The pump includes a pump body and a connecting pipe. The pump body is disposed at an end portion of the molten metal holding furnace, and the end portion is located on the plunger sleeve side. The connecting pipe is connected to the pump body and the plunger sleeve to provide communication between the pump body and the molten metal feed port, and the connecting pipe is separable from the pump body. The die casting apparatus further includes a moving mechanism configured to allow the pump body to move between an inclined state where the pump body is inclined with respect to a horizontal plane in the molten metal holding furnace and an upright state where the pump body is perpendicular to the horizontal plane in the molten metal holding furnace, with the pump body and the connecting pipe separated from each other.

In the die casting apparatus, the moving mechanism may include a sliding portion and a turning portion. The sliding portion may be configured to allow the pump body to move closer to or move away from the connecting pipe with the pump body kept in the inclined state. The turning portion may be configured to allow the pump body to turn to move between the inclined state and the upright state.

In the die casting apparatus, the sliding portion may be configured to slide on a fixed portion to allow the pump body to move closer to or move away from the connecting pipe with the pump body kept in the inclined state; and the turning portion may be configured to turn around a turning axis in the sliding portion to allow the pump body to turn to move between the inclined state and the upright state.

In the die casting apparatus, when the die casting apparatus is used, the pump body may be disposed so as to be inclined with respect to the horizontal plane in the molten metal holding furnace; and when a maintenance work is performed on the die casting apparatus, the pump body may be disposed upright so as to be perpendicular to the horizontal plane in the molten metal holding furnace.

The one aspect of the invention produces the following advantageous effects.

According to the one aspect of the invention, it is possible to prevent the pump from becoming an obstacle to a maintenance work performed by a worker, thereby ensuring a sufficiently wide work space around the die casting apparatus.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, an example embodiment of the invention will be described. It should be noted that the technical scope of the invention is not be limited to the following embodiment.

A die casting apparatus 30 according to an embodiment of the invention will be described with reference to FIG. 1. In this specification, description will be provided with the right side in FIG. 1 being the right side of the die casting apparatus 30 and the left side in FIG. 1 being the left side of the die casting apparatus 30, for the sake of convenience.

Figure 1:
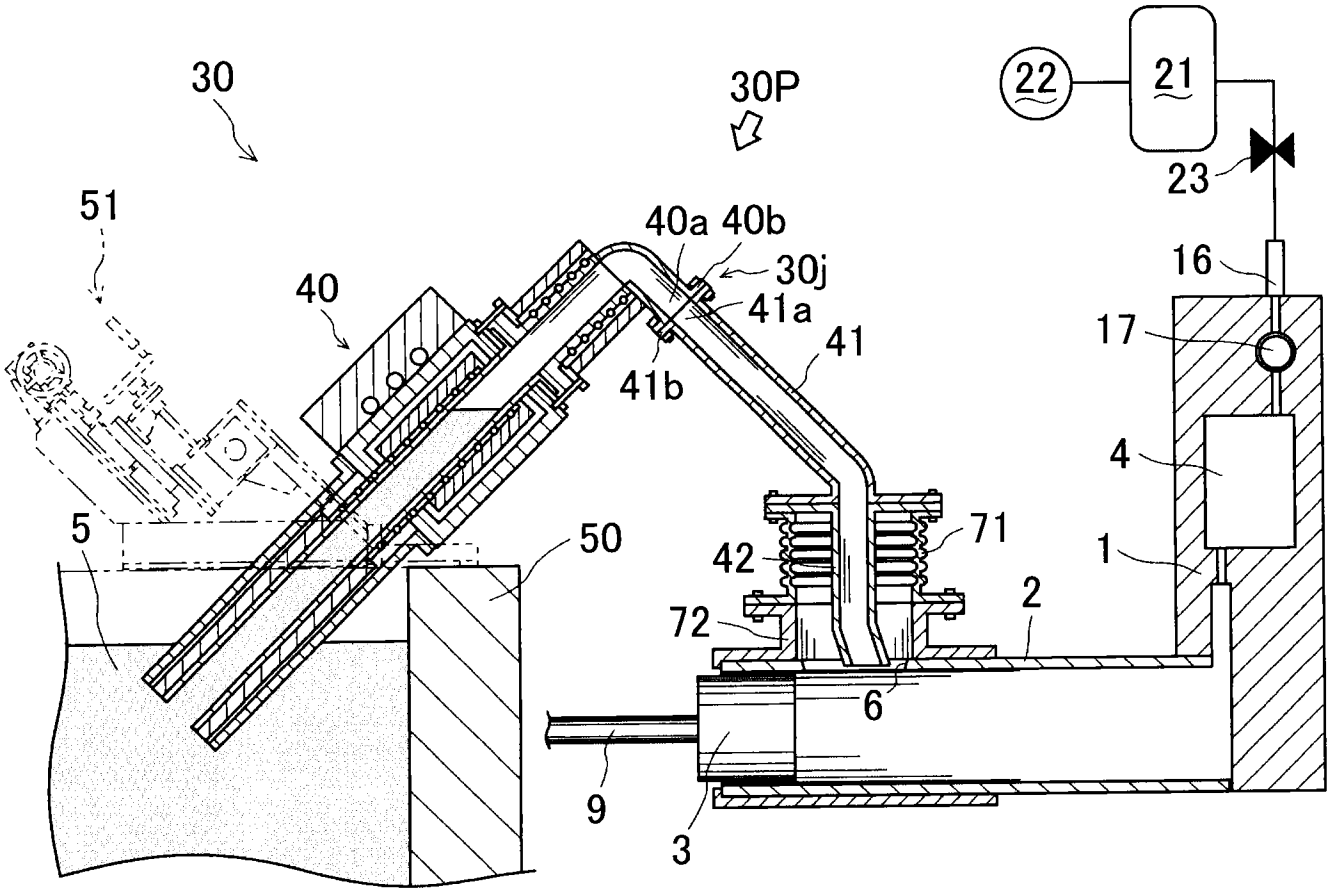
FIG. 1 is a schematic sectional view of a die casting apparatus according to an embodiment of the invention.

As illustrated in FIG. 1, a mold 1 of the die casting apparatus 30 has a cavity 4, and the mold 1 is provided with a plunger sleeve 2 in a generally cylindrical shape. The plunger sleeve 2 is communicated with the cavity 4 and protrudes leftward from the mold 1. A plunger tip 3 in a short columnar shape is configured to be slid rightward in the plunger sleeve 2 to extrude molten metal 5 such as aluminum fed into the plunger sleeve 2, thereby injecting the molten metal 5 into the cavity 4.

The plunger sleeve 2 has a molten metal feed port 6. The molten metal 5 is fed by an electromagnetic pump 30P (described later) into the plunger sleeve 2 through the molten metal feed port 6. A support shaft 9 is inserted into the plunger sleeve 2, and is controlled to be advanced and retracted by an actuator (not illustrated) such as an air cylinder or a hydraulic cylinder. The plunger tip 3 provided at a distal end portion of the support shaft 9 is configured to be slid in the plunger sleeve 2 along the axial direction of the plunger sleeve 2.

The mold 1 is provided with a suction port 16 that is communicated with the cavity 4 to suction the air in the cavity 4. A shut-off valve 17 is provided on a path that connects the cavity 4 to the suction port 16. By connecting the suction port 16 to a depressurizing unit (a depressurizing tank 21 and a vacuum pump 22, in the present embodiment), the depressurizing unit is communicated with the cavity 4. On a connection path that connects the depressurizing tank 21 and the suction port 16 to each other, an opening-closing valve 23 that opens and closes the connection path is provided. When the opening-closing valve 23 on the connection path is opened in accordance with the injection control, depressurization of the cavity 4 is started. In the die casting apparatus 30 according to the present embodiment, the depressurizing unit is provided. However, the die casting apparatus 30 may be configured such that no depressurizing unit is provided.

The die casting apparatus 30 includes a molten metal holding furnace 50 and the electromagnetic pump 30P. The molten metal 5 is stored in the molten metal holding furnace 50. The electromagnetic pump 30P feeds the molten metal 5 in the molten metal holding furnace 50 into the plunger sleeve 2 through the molten metal feed port 6. As illustrated in FIG. 1, the electromagnetic pump 30P is composed of an electromagnetic pump body 40 and connecting pipes 41, 42.

The electromagnetic pump body 40 is placed at the plunger sleeve 2-side end portion of the molten metal holding furnace 50 by a moving mechanism 51 (described later). An upstream end 40*c* (see FIG. 3) of the electromagnetic pump body 40 is immersed in the molten metal 5 in the molten metal holding furnace 50 at an angle of approximately 45 degrees, and the molten metal 5 in the molten metal holding furnace 50 is drawn up from the upstream end 40*c* of the electromagnetic pump body 40.

An inner peripheral portion of the electromagnetic pump body 40 is made of ceramic. When a voltage is applied to a coil embedded in the electromagnetic pump body 40 in accordance with injection control, the electromagnetic pump body 40 draws up the molten metal 5 using an electromagnetic force. In the present embodiment, the electromagnetic pump is used as a pump. However, other kinds of pumps such as a turbopump including a rotor and a positive displacement pump including a rotor may be used.

The connecting pipes 41, 42 are made of ceramic (hereinafter, the connecting pipes 41, 42 will be collectively referred to as "assembly of the connecting pipes 41, 42"). The assembly of the connecting pipes 41, 42 has an upstream end 41*a*, which is one end of the assembly, connected at a junction 30*j* to a downstream end 40*a* of the electromagnetic pump body 40, and a downstream end, which is the other end of the assembly, located at a position at which the downstream end faces the molten metal feed port 6. More specifically, the assembly of the connecting pipes 41, 42 is formed by coupling the upper connecting pipe 41 and the lower connecting pipe 42 to each other. The upper connecting pipe 41 is connected at the upstream end 41*a* to the downstream end 40*a* of the electromagnetic pump body 40, and is disposed so as to be inclined downward toward the plunger sleeve 2. An upstream end of the lower connecting pipe 42 is connected to a downstream end of the upper connecting pipe 41, and is disposed so as to be perpendicular to the molten metal feed port 6. That is, when the assembly of the connecting pipes 41, 42 is connected to the electromagnetic pump body 40 and the plunger sleeve 2, communication is provided between the electromagnetic pump body 40 and the molten metal feed port 6.

As illustrated in FIG. 1, the assembly of the connecting pipes 41, 42 is configured to be separable from the electromagnetic pump body 40. More specifically, a flange 40*b* is provided at the downstream end 40*a* of the electromagnetic pump body 40, and a flange 41*b*, which is brought into contact with the flange 40*b*, is provided at the upstream end 41*a* of the upper connecting pipe 41. When the flange 40*b* and the flange 41*b* brought into contact with each other are fastened together with a fastening member such as a bolt, the upper connecting pipe 41 and the electromagnetic pump body 40 are connected to each other at the junction 30*j*. In other words, the assembly of the connecting pipes 41, 42 and the electromagnetic pump body 40 are separated from each other by removing the fastening member.

The assembly of the connecting pipes 41, 42 is coupled to the plunger sleeve 2 via a heat insulation member 72 and an intermediate pipe 71 having a bellows structure and serving as a vibration absorber. More specifically, the plunger sleeve 2 is provided with the heat insulation member 72, which is made of metal or ceramic and formed in a shape of a pipe communicated with the molten metal feed port 6 of the plunger sleeve 2, and the intermediate pipe 71 is connected to the heat insulation member 72. The intermediate pipe 71 is disposed on the upper side of the heat insulation member 72, and a junction between the upper connecting pipe 41 and the lower connecting pipe 42 is supported by the intermediate pipe 71. That is, an upper end portion of the intermediate pipe 71, which is located on the upper connecting pipe 41 side, is coupled to the junction between the upper connecting pipe 41 and the lower connecting pipe 42, which is an intermediate portion of the assembly of the connecting pipes 41, 42, and a lower end portion of the lower connecting pipe 42, which is the other end portion of the assembly of the connecting pipes 41, 42, is located near the molten metal feed port 6.

The die casting apparatus 30 according to the present embodiment is configured as described above, and performs casting by performing an injecting operation with the inside of the cavity 4 depressurized. In the injecting operation, the molten metal 5 fed into the plunger sleeve 2 by the electromagnetic pump body 40 from the molten metal holding furnace 50 through the connecting pipes 41, 42 is extruded rightward by the plunger tip 3 to be injected into the cavity 4.

Figure 2A:
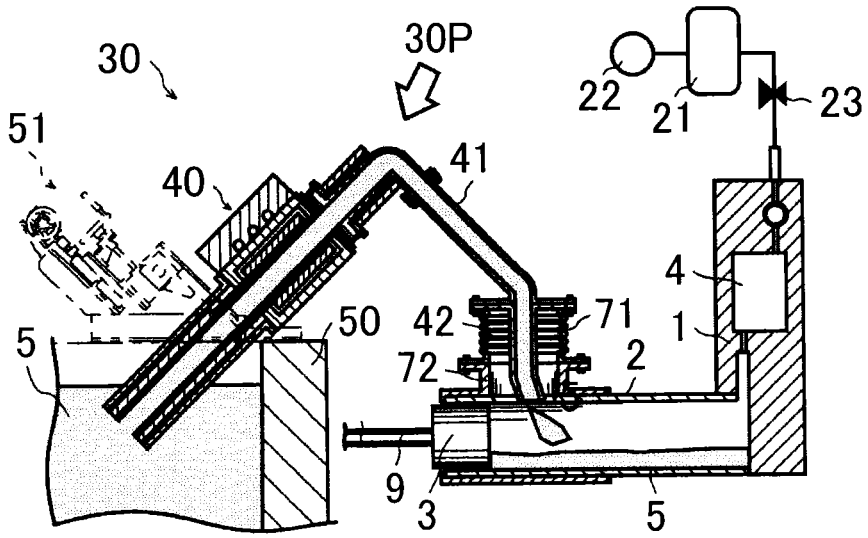
FIG. 2A is a schematic sectional view of the die casting apparatus during feeding of molten metal

Next, a vacuum die casting process performed by the die casting apparatus 30 will be described with reference to FIG. 2A to FIG. 2C. First, during molten metal feeding performed in the die casting apparatus 30 as illustrated in FIG. 2A, the molten metal 5 is drawn up by an electromagnetic force of the electromagnetic pump body 40 and the molten metal 5 is fed through the connecting pipes 41, 42 into the plunger sleeve 2 from the molten metal feed port 6. A distal end portion of the plunger tip 3 in the injection direction is located at a position before the molten metal feed port 6 (i.e., a position at which the plunger tip 3 has not reached the molten metal feed port 6), so that the molten metal feed port 6 is left fully open. Further, the opening-closing valve 23 is kept closed, so that depressurization is not performed.

Figure 2B:
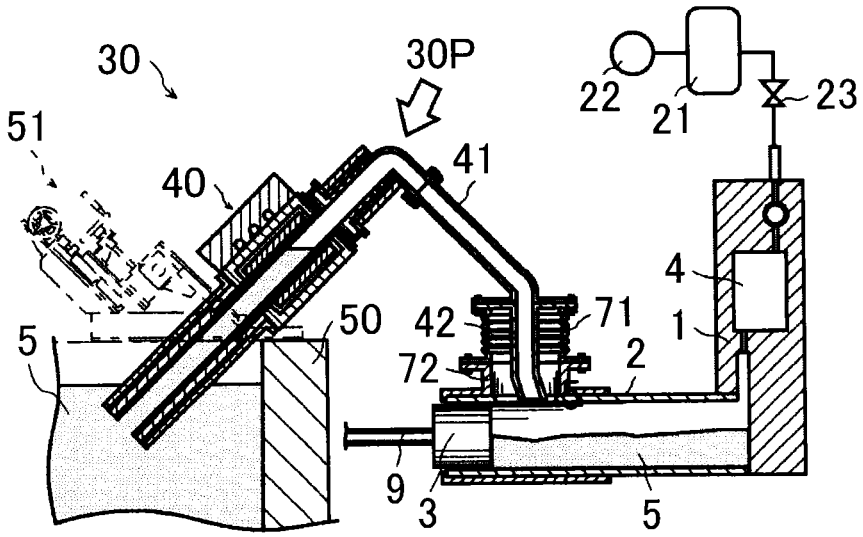
FIG. 2B is a schematic sectional view of the die casting apparatus during depressurization.

Next, during depressurization in the die casting apparatus 30 as illustrated in FIG. 2B, the opening-closing valve 23 is opened, so that depressurization of the cavity 4 is started.

Figure 2C:
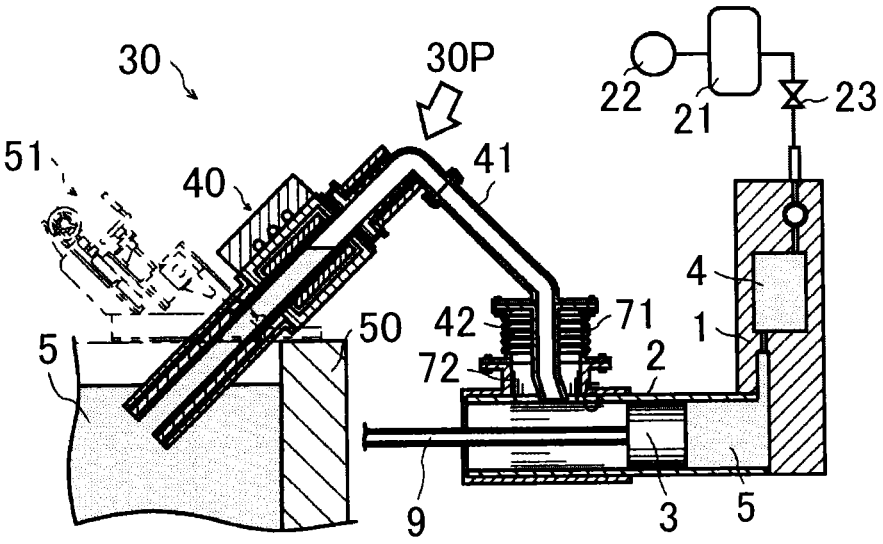
FIG. 2C is a schematic sectional view of the die casting apparatus during injection.

During injection performed in the die casting apparatus 30 as illustrated in FIG. 2C, the molten metal 5 is injected into the cavity 4, in which a prescribed degree of vacuum is secured, through the injecting operation of the plunger tip 3. During a period in which the injecting operation is performed, the opening-closing valve 23 is kept open, so that the air in the cavity 4 is continuously suctioned. Then, after the plunger tip 3 has completely moved to the injection side, the opening-closing valve 23 is closed and the depressurization is completed. After a product in the cavity 4 solidifies, the mold is removed to take out the product.

The die casting apparatus 30 according to the present embodiment includes the moving mechanism 51 that moves the electromagnetic pump body 40 between an inclined state and an upright state after separating the electromagnetic pump body 40 and the assembly of the connecting pipes 41, 42 from each other. The moving mechanism 51 will be described with reference to FIG. 3 to FIG. 6.

Figure 3:
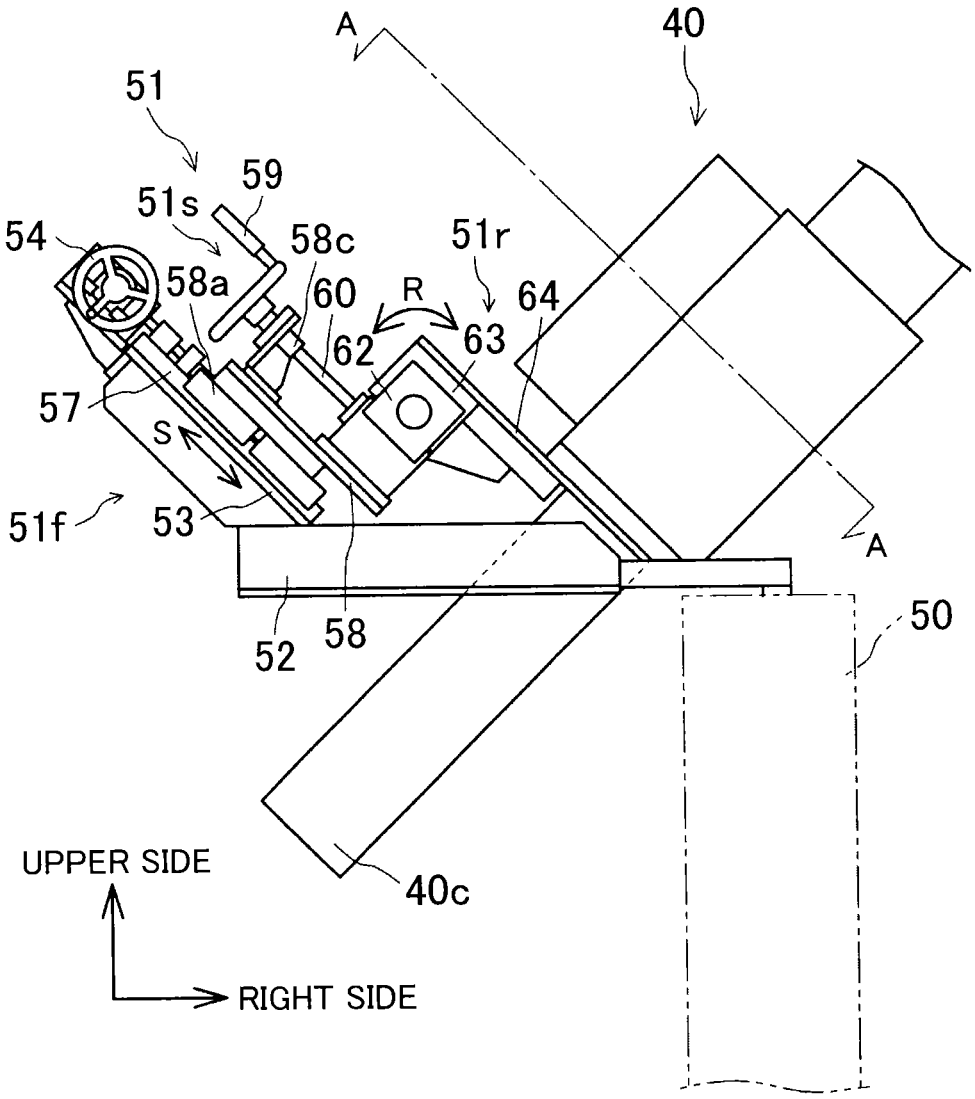
FIG. 3 is a side view of a moving mechanism.
Figure 4:
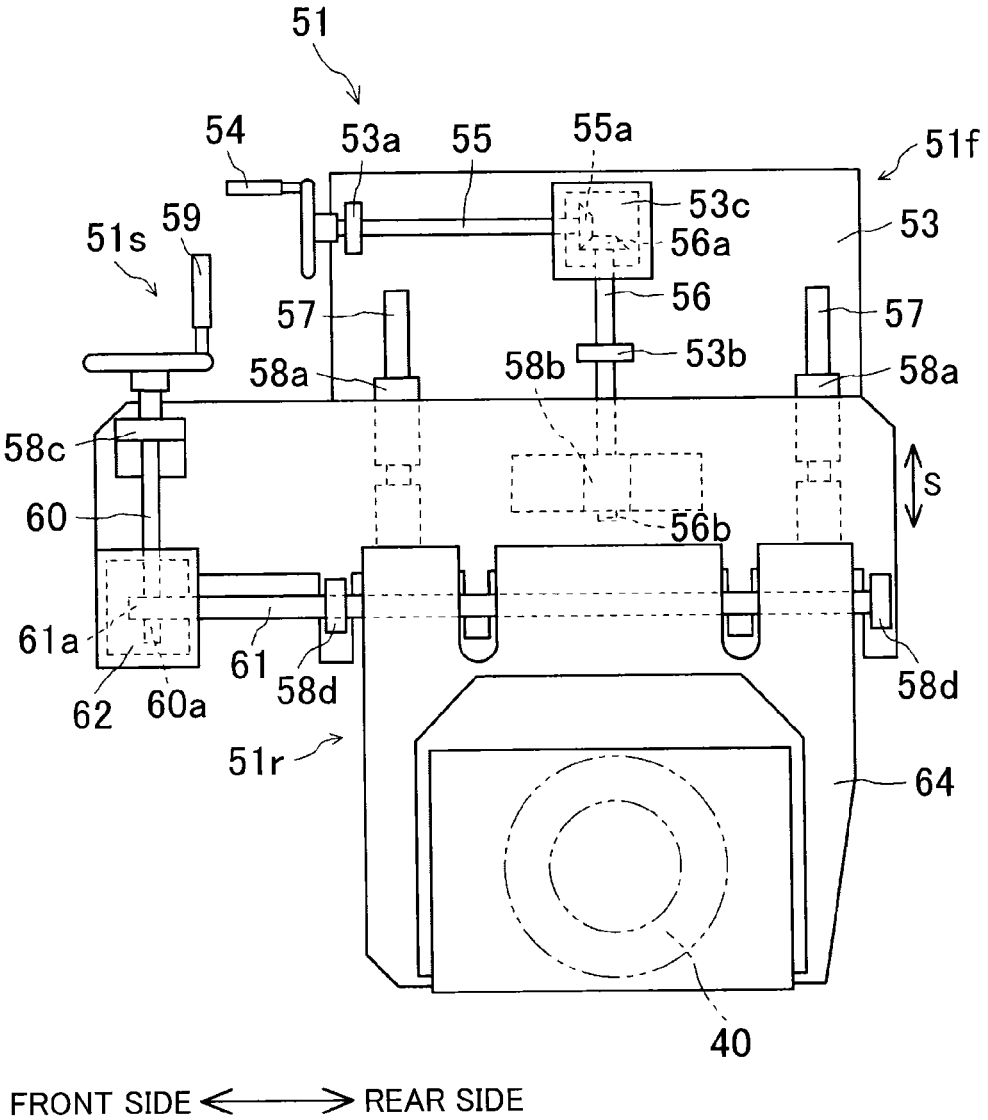
FIG. 4 is a view of the moving mechanism taken along the line A-A in FIG. 3.
Figure 6:
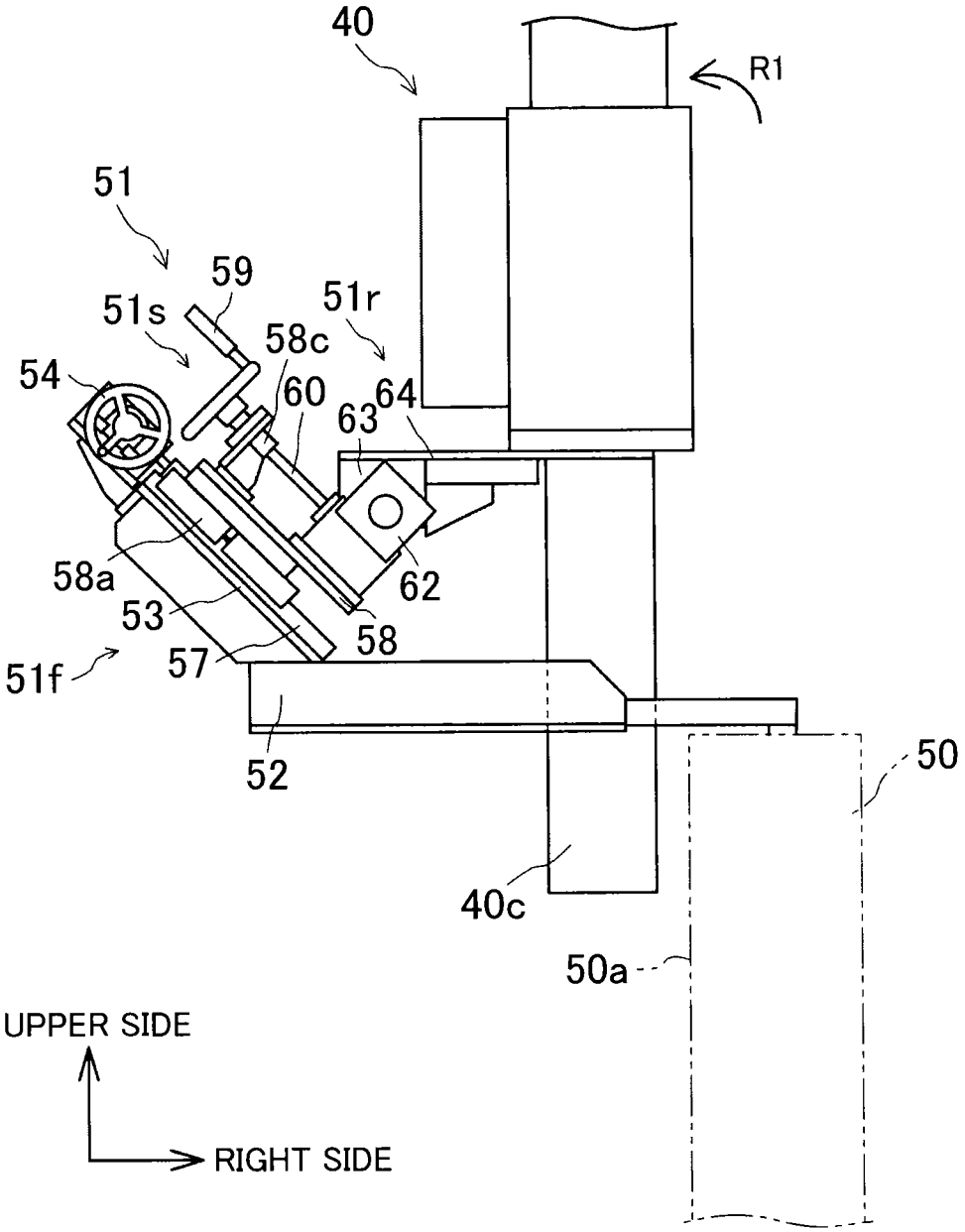
FIG. 6 is a side view of the moving mechanism after a turning portion is turned.

As illustrated in FIG. 1 and FIG. 3, when the die casting apparatus 30 is used, the electromagnetic pump body 40 is disposed in such a posture that the electromagnetic pump body 40 is inclined at an angle of approximately 45 degrees with respect to the horizontal plane in the molten metal holding furnace 50 (inclined state). When a worker performs, for example, a maintenance work, the electromagnetic pump body 40 is disposed in such a posture that the electromagnetic pump body 40 is perpendicular to the horizontal plane in the molten metal holding furnace 50 (upright state) as illustrated in FIG. 6 in order to ensure a sufficiently wide work space around the die casting apparatus 30. Thus, the moving mechanism 51 moves the electromagnetic pump body 40, which has been separated from the assembly of the connecting pipes 41, 42, between the inclined state and the upright state.

The moving mechanism 51 includes a fixed portion 51*f*, a sliding portion 51*s*, and a turning portion 51*r*. The sliding portion 51*s* slides on the fixed portion 51*f* in the left-right direction (more specifically, in the upper left-lower right direction; the same applies hereinafter) to allow the electromagnetic pump body 40 to move closer to or move away from the assembly of the connecting pipes 41, 42 with the electromagnetic pump body 40 kept in the inclined state. The turning portion 51*r* turns around a turning axis extending in the front-rear direction (the direction perpendicular to the sheet on which each of FIG. 1 and FIG. 3 is drawn) in the sliding portion 51*s*, to allow the electromagnetic pump body 40 to turn to move between the inclined state and the upright state. These portions will be described in sequence below.

The fixed portion 51*f* mainly includes a base 52, a rail support 53, and a sliding handle 54. The base 52 is a member in the form of a plate and fixed horizontally to the molten metal holding furnace 50. The rail support 53 in the form of a plate is fixed to a left end portion of the base 52 so as to extend from the left end portion toward the upper left side at an angle of approximately 45 degrees. On the upper surface of the rail support 53, slide rails 57, 57 extending along the left-right direction are disposed at two respective positions, one of which is located on the front side and the other of which is located on the rear side.

At the front portion of the upper surface of the rail support 53, the sliding handle 54 is disposed so as to be turnable around a shaft 55 of which the axis extends in the front-rear direction. The shaft 55 is turnably supported by a shaft support 53*a* and a case 53*c* on the rail support 53. A bevel gear 55*a* is formed at the rear end portion of the shaft 55.

At a central portion of the upper surface of the rail support 53 in the front-rear direction, a shaft 56, of which the axis extends in the left-right direction, is disposed so as to be perpendicular to the shaft 55. The shaft 56 is turnably supported by a shaft support 53*b* and the case 53*c* on the rail support 53. A bevel gear 56*a* is formed at the left end portion of the shaft 56. The bevel gear 55*a* and the bevel gear 56*a* are meshed with each other in the case 53*c*. An external thread 56*b* is formed at the right end portion of the shaft 56.

The sliding portion 51*s* mainly includes a sliding plate 58 and a turning handle 59. The sliding plate 58 is a member in the form of a plate, which is disposed so as to be slidable in the left-right direction on the upper surface of the rail support 53. More specifically, sliders 58*a*, 58*a* are disposed on the lower surface of the sliding plate 58, and the sliders 58*a*, 58*a* are disposed so as to be slidable on the slide rails 57, 57. Thus, the sliding plate 58 is allowed to slide in the left-right direction on the upper surface of the rail support 53 as indicated by arrows S in FIG. 3 and FIG. 4.

An internal thread 58*b* is provided between the sliders 58*a*, 58*a* on the lower surface of the sliding plate 58, and the external thread 56*b* formed at the right end portion of the shaft 56 is screwed into the internal thread 58*b*.

With the above-described configuration, when a worker turns the sliding handle 54 in the above-described configuration, the turn is transmitted to the shaft 55. The turn of the shaft 55 is transmitted to the shaft 56 through the bevel gear 55*a* and the bevel gear 56*a*. As the shaft 56 turns, the internal thread 58*b*, into which the external thread 56*b* is screwed, and the sliding plate 58 move in the left-right direction. Thus, as the worker operates the sliding handle 54, the sliding portion 51*s* slides in the left-right direction as indicated by the arrows S in FIG. 3 and FIG. 4 (see FIG. 5).

At the front end portion of the upper surface of the sliding plate 58, the turning handle 59 is disposed so as to be turnable around a shaft 60 of which the axis extends in the left-right direction. The shaft 60 is turnably supported by a shaft support 58*c* and a case 62 on the sliding plate 58. A helical gear 60*a* is formed at the right end portion of the shaft 60.

The turning portion 51*r* mainly includes a shaft 61, a turning support 63, and a pump support plate 64. The pump support plate 64 is a member in the form of a plate, which is disposed at the right end portion of the sliding plate 58 so as to be turnable around the shaft 61 of which the axial direction extends in the front-rear direction. The electromagnetic pump body 40 is disposed at a central portion of the pump support plate 64, and the electromagnetic pump body 40 is configured to be turnable together with the pump support plate 64.

The shaft 61 is turnably supported by shaft supports 58*d*, 58*d* on the sliding plate 58. A helical gear 61*a* is formed at the front end portion of the shaft 61. The helical gear 60*a* of the shaft 60 and the helical gear 61*a* of the shaft 61 are meshed with each other in the case 62. The turning support 63 is fixed to the shaft 61, and the pump support plate 64 is fixed to the turning support 63.

With the above-described configuration, when the worker turns the turning handle 59, the turn is transmitted to the shaft 60. The turn of the shaft 60 is transmitted to the shaft 61 through the helical gear 60*a* and the helical gear 61*a*. The turn of the shaft 61 causes the turning support 63 and the pump support plate 64 to turn around the shaft 61. Thus, as the worker operates the turning handle 59, the turning portion 51*r* turns around the shaft 61, of which the axis extends in the front-rear direction, as indicated by arrows R in FIG. 3 (see FIG. 6).

As described above, the die casting apparatus 30 according to the present embodiment includes the moving mechanism 51 that moves the electromagnetic pump body 40, which has been separated from the assembly of the connecting pipes 41, 42, from the inclined state to the upright state, when the worker performs, for example, a maintenance work around the die casting apparatus 30.

Figure 5:
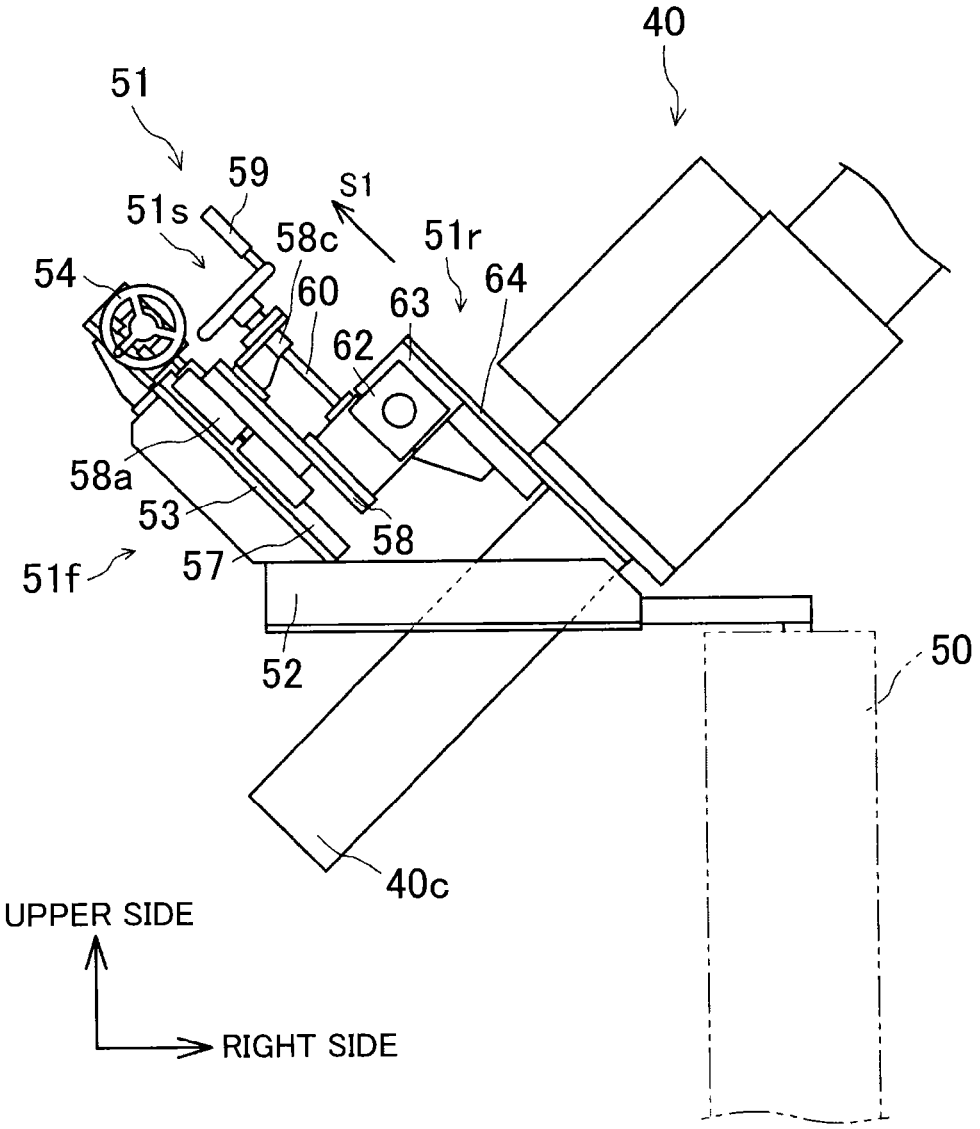
FIG. 5 is a side view of the moving mechanism after a sliding portion is slid.

More specifically, first, as the worker operates the sliding handle 54 when the electromagnetic pump body 40 is in the inclined state as illustrated in FIG. 3, the sliding portion 51*s* and the turning portion 51*r* slide together with each other to the left side as indicated by an arrow S1 in FIG. 5. Thus, the electromagnetic pump body 40 also moves to the upper left side from the position illustrated in FIG. 3, and then separates from the assembly of the connecting pipes 41, 42. Next, as the worker operates the turning handle 59, the turning portion 51*r* turns as indicated by an arrow R1 in FIG. 6, and then the electromagnetic pump body 40 is brought into the upright state.

With the above-described configuration, in the die casting apparatus 30 according to the present embodiment, it is possible to bring the electromagnetic pump body 40 into the upright state on the upper side of the molten metal holding furnace 50. Thus, the electromagnetic pump body 40 does not become an obstacle to a work performed around the die casting apparatus 30 by the worker. This makes it possible to ensure a sufficiently wide work space around the die casting apparatus 30.

In the die casting apparatus 30 according to the present embodiment, the moving mechanism 51 includes the sliding portion 51*s* that allows the electromagnetic pump body 40 to move closer to or move away from the assembly of the connecting pipes 41, 42 with the electromagnetic pump body 40 kept in the inclined state, and the turning portion 51*r* that turns around the turning axis extending in the front-rear direction in the sliding portion 51*s*, to allow the electromagnetic pump body 40 to turn to move between the inclined state and the upright state.

As described above, in the die casting apparatus 30, after the electromagnetic pump body 40 is moved away from the assembly of the connecting pipes 41, 42 by the sliding portion 51*s*, the electromagnetic pump body 40 is turned by the turning portion 51*r*. Thus, as illustrated in FIG. 6, it is possible to prevent contact between the upstream end 40*c* and a wall surface 50*a* of the molten metal holding furnace 50 when the electromagnetic pump body 40 is turned. In other words, when the electromagnetic pump body 40 is brought into the inclined state, the electromagnetic pump body 40 is moved closer to the assembly of the connecting pipes 41, 42 by the sliding portion 51*s*, so that the feeding path through which the molten metal is fed when the die casting apparatus 30 is used is shortened.

In the present embodiment, the worker operates the sliding handle 54 and the turning handle 59 in the moving mechanism 51. However, the sliding portion 51*s* and the turning portion 51*r* of the moving mechanism 51 may be moved by controlling an actuator such as a motor.

What is claimed is:

1. A die casting apparatus comprising:

a mold having a cavity;

a plunger sleeve having a molten metal feed port, the plunger sleeve being communicated with the cavity;

a plunger tip provided at a distal end portion of a support shaft, the plunger tip configured to be slidable in the plunger sleeve in an axial direction of the plunger sleeve when the support shaft is inserted into the plunger sleeve;

a molten metal holding furnace in which molten metal is stored; and a pump that feeds the molten metal from the molten metal holding furnace into the plunger sleeve, wherein casting is performed through an injecting operation in which the molten metal fed into the plunger sleeve is extruded by the plunger tip to be injected into the cavity, the pump includes a pump body and a connecting pipe, the pump body being disposed at an end portion of the molten metal holding furnace, the end portion being located on the plunger sleeve side, the connecting pipe being connected to the pump body and the plunger sleeve to provide communication between the pump body and the molten metal feed port, and the connecting pipe being separable from the pump body, and the die casting apparatus further comprises a moving mechanism configured to allow the pump body to move between an inclined state where the pump body is inclined with respect to a horizontal plane in the molten metal holding furnace and an upright state where the pump body is perpendicular to the horizontal plane in the molten metal holding furnace, with the pump body and the connecting pipe separated from each other.

2. The die casting apparatus according to claim 1, wherein the moving mechanism includes a sliding portion and a turning portion, the sliding portion configured to allow the pump body to move closer to or move away from the connecting pipe with the pump body kept in the inclined state, and the turning portion configured to allow the pump body to turn to move between the inclined state and the upright state.

3. The die casting apparatus according to claim 2, wherein:

the sliding portion is configured to slide on a fixed portion to allow the pump body to move closer to or move away from the connecting pipe with the pump body kept in the inclined state; and the turning portion is configured to turn around a turning axis in the sliding portion to allow the pump body to turn to move between the inclined state and the upright state.

4. The die casting apparatus according to claim 1, wherein:

when the die casting apparatus is used, the pump body is disposed so as to be inclined with respect to the horizontal plane in the molten metal holding furnace; and when a maintenance work is performed on the die casting apparatus, the pump body is disposed upright so as to be perpendicular to the horizontal plane in the molten metal holding furnace.

* * * * *